United States Patent [19]

Vanoni

[11] Patent Number: 4,881,462

[45] Date of Patent: Nov. 21, 1989

[54] PORTABLE ELECTRICAL LABELLING MACHINE

[75] Inventor: Carlo Vanoni, Varese, Italy

[73] Assignee: Mida S.r.l., Varese, Italy

[21] Appl. No.: 166,239

[22] Filed: Mar. 10, 1988

[30] Foreign Application Priority Data

Mar. 17, 1987 [IT] Italy ..... 21146 B/87

[51] Int. Cl.[4] ..... B41F 1/02

[52] U.S. Cl. ..... 101/292

[58] Field of Search ..... 101/292, 291, 288; 156/384

[56] References Cited

U.S. PATENT DOCUMENTS

| | | | |
|---|---|---|---|
| 2,696,784 | 12/1954 | Geiler | 101/292 |
| 3,376,811 | 4/1968 | Grintz . | |
| 3,420,172 | 1/1969 | Kaplan | 101/291 |
| 3,791,293 | 2/1974 | Rastorguyeff et al. | 101/292 X |
| 3,902,419 | 9/1975 | Pflugbeil et al. | 101/291 |
| 4,264,396 | 4/1981 | Stewart | 101/291 X |
| 4,386,860 | 6/1983 | Price et al. . | |
| 4,579,466 | 4/1986 | Sato et al. | 101/288 X |
| 4,706,096 | 11/1987 | Sato | 101/288 X |
| 4,724,033 | 2/1988 | Vanderpool et al. | 101/288 X |

FOREIGN PATENT DOCUMENTS

| | | | |
|---|---|---|---|
| 2573036 | 5/1986 | France | 101/292 |

*Primary Examiner*—Clifford D. Crowder

*Attorney, Agent, or Firm*—Robbins & Laramie

[57] ABSTRACT

A portable electrical labeling machine is capable of printing and dispensing labels automatically. A driving device engages label-carrying tape that is transparent to infra-red rays, drawing the tape past a photocell and a printing stamp. The photocell detects the presence of a label on the tape such that when a label is adjacent the photocell, the stamp and driving device are activated. The printing stamp and driving device are deactivate when the photocell detects a gap between adjacent labels.

15 Claims, 3 Drawing Sheets

PORTABLE ELECTRICAL LABELLING MACHINE

The present invention is concerned with a portable electrical labelling machine.

The labelling machines presently available from the market can be substantially reduced to two types. A first type is a portable, mechanical type, capable of dispensing labels when a simple pressure is applied to a purposely provided trigger.

A second type is a fixed, automatic type for use on high-production-rate packaging lines, powered by electrical energy, and therefore irremovable from said lines.

In practice, a labelling machine which is capable of averaging, from a techinical and economical standpoint, the characteristics of above mentioned labelling machines, does not exist.

The purpose of the present invention is to provide a labelling machine which is electrical, completely automatic and handy enough, for being transported and used by a single user, and which, if need be, can be associated with automatic packaging lines.

This and still further purposes of the present finding are achieved by an electrical, portable labelling machine, characterized in that it comprises, in combination: a body, with a handle, said body being associated with a label-roll-holder device, from which a roll of label-carrier tape is unwound, which includes a label supporting band of silicone-treated paper; and a printing device located in series to the previous device, both devices being actuated in sequence by an electronic logic circuit, as well as means for binding said labelling machines to supporting means.

The invention is illustrated in the drawings for purely exemplary, and not limiting purposes.

Figure 1:
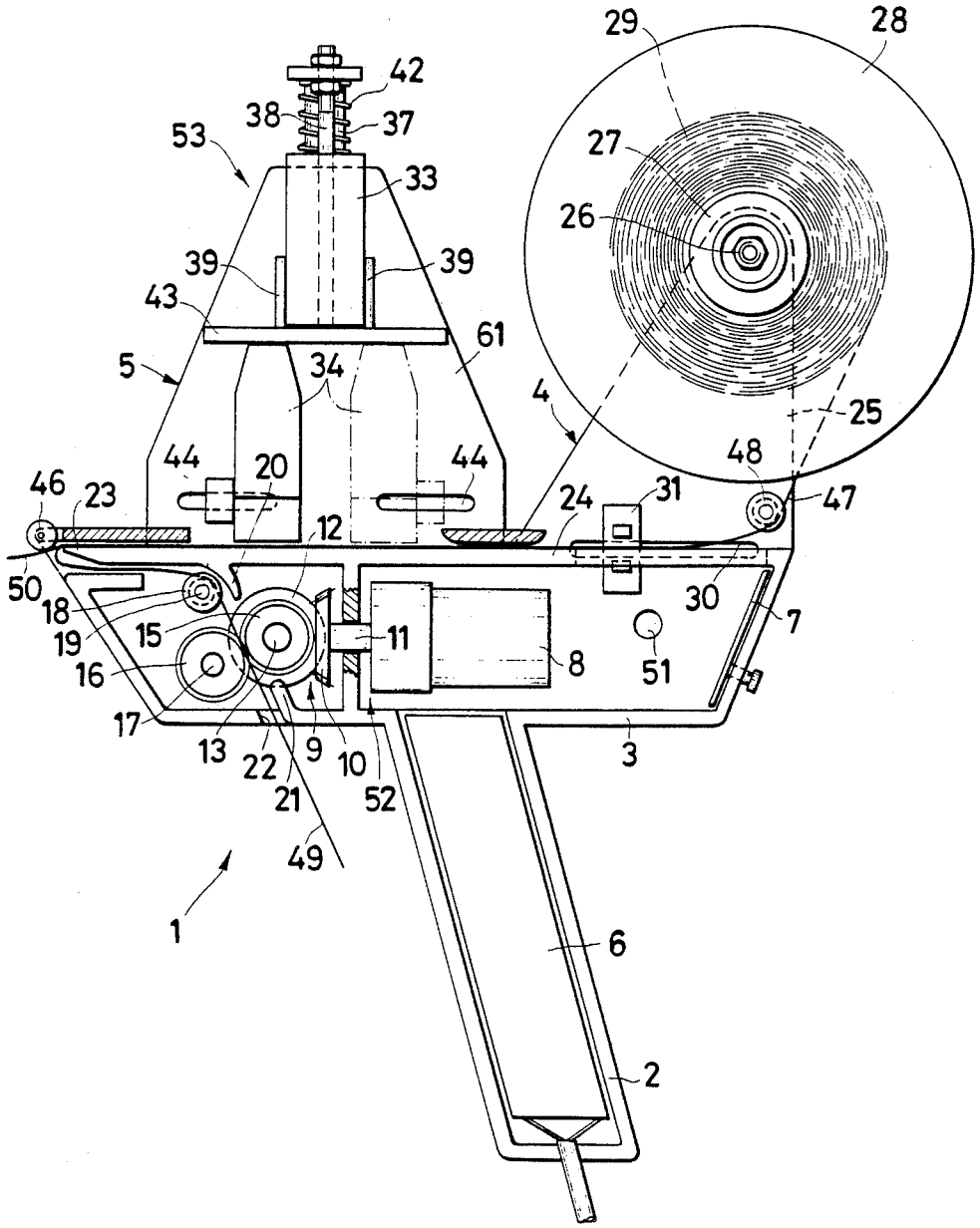
FIG. 1 shows a side view of the labelling machine of the invention, with its side lids being removed.

Referring to the above cited figures, the labelling machine of the present invention, generally indicated by the reference numeral 1, includes a body 3, with a handle 2. Above the rear portion of the body 3, a label-holder device 4 is installed, and above the front portion of the body 3, a printing device 5 is installed. Inside the interior of the body 3 a tape driving device, generally indicated by the reference numeral 52, is installed.

The handle 2 contains a first electronic card 6, directly connected with the electrical power supply system, which governs the regulated operation of the labelling machine 1.

The body 3 contains a second electronic card 7, which controls the operation of the printing device 5, and tape driving device 52. A ratiomotor 8, driving a couple of bevel gear wheels 9, are part of this latter device.

Figure 3:
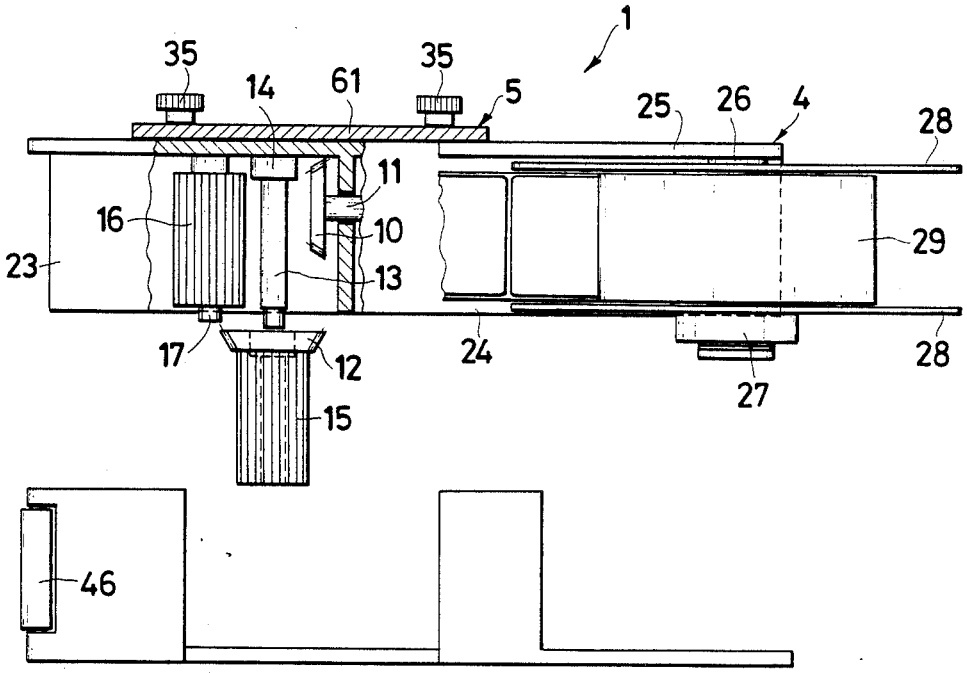
FIG. 3 shows a partially exploded top view of the labelling machine, from which the printing device is removed.

The couple of bevel gear wheels 9 includes a first gear wheel 10, keyed on the shaft 11 of the ratiomotor 8. A second bevel gear wheel 12 is supported by a pivot 13, with a unidirectional bearing 14, positioned therebetween (FIG. 3).

The gear wheel 12 is integral, through its front face surface, with a first driving roller 15 also supported by the pivot 13. The first driving roller 15 is provided with a side surface having a splined outline that engages the corresponding outline provided on a second tape driving roller 16, antagonist to the first roller, and supported by a pivot 17. A support roller 18, idling relative to its pivot 19, and a couple of guides 20 and 21 lying on a same plane—with this latter plane passing through the points of contact of the splined outlines of the rollers 15 and 16—are furthermore provided.

At the basis of the guide 21, an outlet slot 22 is provided, and at the basis of the guide 20 a sharp edge having a knife-edge shape 23 is provided. Said sharp edge 23 constitutes the end side of a sliding plane 24, opposite rubber-coated roller 46.

The label roll holder device 4 includes a single upright 25 supporting a pivot 26, a disk-clutch 27 and a couple of disks 28, between which a traditional roll of labels 29 is housed.

Visible at the base of the upright 25 is a groove 30, for adjusting the positioning of a photocell 31, and a guide roller 48.

The printing device 5 comprises an upright 61, with which an electromagnet 33, and a self-inking stamp 34 of traditional type are integral. The upright 61 is adjustable in height relative to the sliding plane 24 due to slots 32 associated with locking means 35, FIG. 2,. The position of electromagnet 33 can also be adjusted in height due to a slot 40 associated with locking means 41. The electromagnet 33 acts on a movable equipment 53 comprising a core 37, sliding inside the interior of the electromagnet 33, a reaction spring 42, stud screws 38 and guides 39. The guides 39 are integral with a blade 43, which lies on a plane parallel to the sliding plane 24.

Between the blade 43 and said sliding plane, are slots 44 and locking means 45, which aid in the adjustment of the position of one or two self-inking stamp(s) 34, pressed against the sliding plane 24 by the blade 43. The rolls 29 used by the label dispensing machine 1 are formed by the winding on itself of a label-carrier tape 47 comprising a continuous band of silicone-treated paper 49 on which pressure-sensitive labels 50 are lined-up, shortly spaced apart from each other.

On the body 3 is a through-bore 51 which is engagable with binding means (not shown in the figures) in order to fasten the labelling machine 1 to traditional labelling lines.

Figure 2:
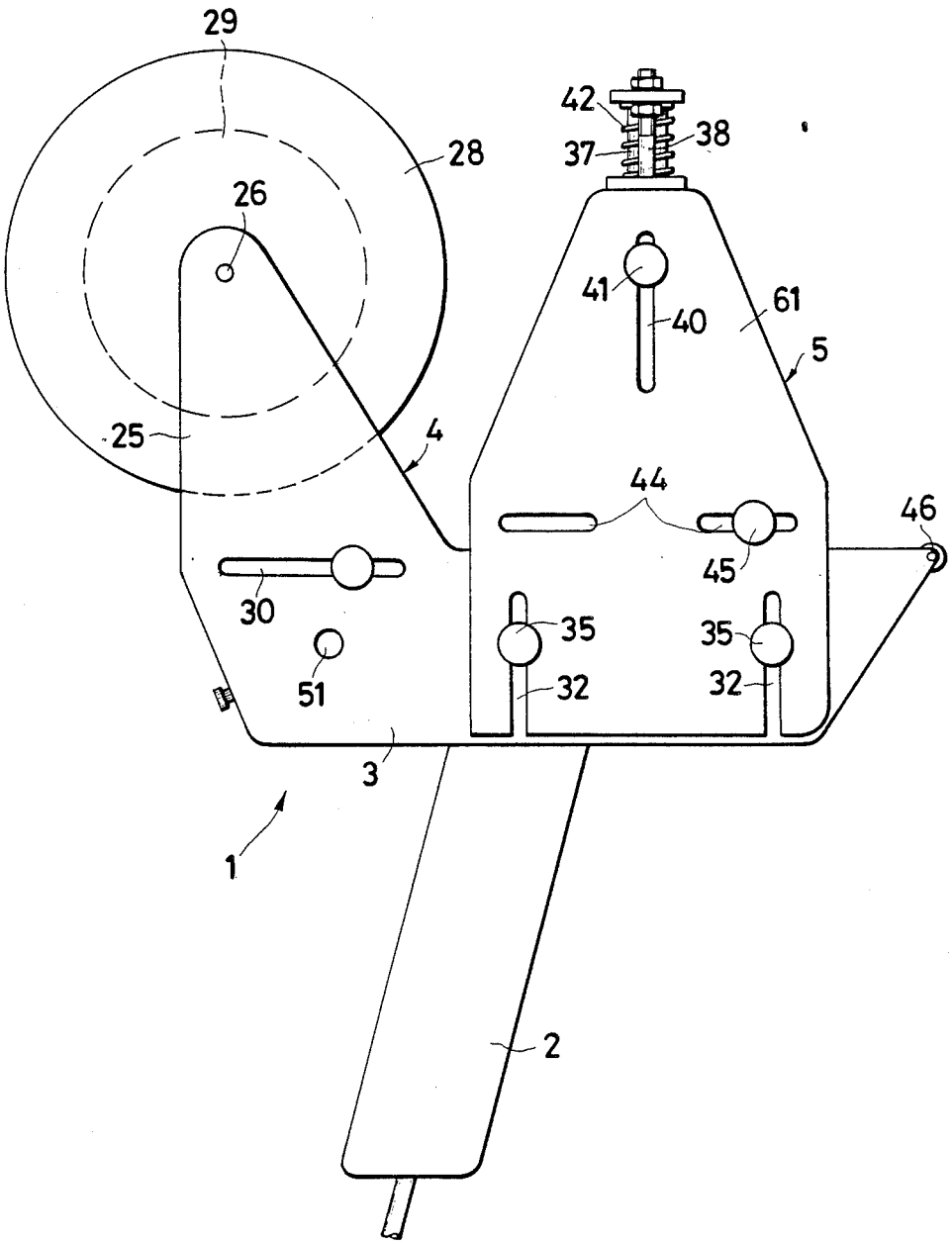
FIG. 2 shows a side view opposite to that of FIG. 1.

The operation of the device 1 is not disclosed by reference to the arrangement shown in FIGS. 1 and 2.

In a situation where the label dispensing machine 1 is disabled the photocell 31 is not obscured. An infrared light beam emitted by the photocell 31 passes through the label carrier tape 47, between two adjacent labels, and is received by the photocell 31. The silicone-treated paper 49 on which the labels are placed is transparent to said beam.

The photocell 31 can be replaced by an adjustable pressure sensor making it possible to account for the thickness and thus enabling labels to be applied which are made on transparent materials such as PVC, cellulose acetate, polyester sheet, and so forth.

It is possible to start applying the labels to a surface by adhering the outermost edges of the labels 50 that protrude beyond the sharp edge 23 to the surface on which the labels are to be applied.

By starting to apply the labels 50, the tape 47 advances through a short distance, causing the photocell 31 to be obscured by any labels thereon. Consequently the electrical circuits of the electronic cards 6 and 7 are enabled. The ratiomotor 8 transmits motion to the rollers 15 and 16, which pull the band of silicone-treated paper 49, causing it to round the edge 23 and the label 50 to separate from the paper band 49. When the printing device 5 is enabled, the movable equipment, comprising the elements 34, 37, 42, 38, 39 and 43, consequently applies a downwards-directed pressure to the stamp 34 which prints on one of the labels upstream from where the labels are applied to a surface.

The roller 46 presses on the label during the application step, completing the adhesive-bonding thereof. The photocell "reads" again the gap existing between a couple of adjacent labels thereby stopping the device.

The instantaneous stopping of the device, with the perfect elimination of any inertial forces, is achieved by reversing the polarity of the ratiomotor 8. The consequent reversing in revolution direction, however, is blocked by the unidirectional bearing 14.

Also the roller 29 is instantaneously stopped, due to the action of the disk clutch 27.

By varying the position of the photocell 31 relatively to the groove 30, the use of labels of different lengths is possible.

Furthermore, the printing parameters can be changed by using the stroke allowed by the slots 40, 32 and 44 to adjust the means which engage them.

I claim:

1. A portable electrical labelling machine for applying labels carried by a tape to an object, comprising:

a body having a tape path therein and a handle portion attached thereto;

a tape holder coupled to said body for carrying a roll of said label-carrying tape, said tape comprising a continuous band of paper transparent to infra-red light and which supports the labels in spaced relationship so that a gap of transparent paper is between the spaced labels;

photocell detection means coupled to said body in the tape path for emitting and receiving infra-red light across the tape path and being responsive to produce an enabling output in the absence of received light resulting from the presence of a label therein and being responsive to produce a disabling output in response to received infra-red light passing through the transparent tape in the gap between the labels;

a printing device responsively coupled to said photocell detection means, for printing a label upon the occurrence of said enabling output; and drive means responsively coupled to said photocell detection means for pulling said tape upon the occurrence of said enabling output such that said tape is unwound from said holder means and the label is withdrawn from said photocell detection means, said drive means being disabled in response to the occurrence of the disabling output to stop the tape.

2. A machine according to claim 1, wherein said drive means comprises first and second opposed knurled tape-driving rollers in the tape path for drawing the tape therethrough, and a motor coupled to the first and second knurled rollers for driving them when said drive means is enabled.

3. A machine according to claim 2, wherein said body includes an idler in the tape path upstream of the knurled rollers, and guide means in the tape path for guiding said band of paper into engagement with said first and second knurled rollers.

4. A machine according to claim 2, wherein said drive means further comprises first and second bevel gears interconnecting said motor and said first knurled tape-driving roller, said second bevel gear being integral with said first roller.

5. A machine according to claim 2 further comprising unidirectional bearing means engaging at least one of the first and second knurled rollers for preventing reversal of the tape in the tape path.

6. A machine according to claim 1 wherein said body further includes a sharp label separating edge in the tape path around which said tape is positioned for facilitating separation of said labels from said band of paper.

7. A machine according to claim 1, wherein said printing device comprises an upright adjustably fixed to said body and an electromagnet movably supported by said upright and a self inking stamp carried by the electromagnet for engaging the label.

8. A machine according to claim 7 wherein said body includes a sliding plane on which said tape slides in the tape path in confronting relation with the self inking stamp as the tape is drawn through the printing device such that said self inking stamp, when acted upon by said electromagnet, prints the labels on said tape against the sliding plane.

9. A machine according to claim 7, wherein said printing device further comprises first adjusting means for adjusting the position of said upright with respect to said body, second adjusting means for adjusting the position of said stamp with respect to said upright, and third adjusting means for adjusting the position of said electromagnet with respect to said upright.

10. A machine according to claim 9, wherein said first, second and third adjustment means comprise slot and pin arrangements.

11. A machine according to claim 1, wherein said holder means comprises a support connected to said body; a pivot carried by said support; two end retainer disks and an intermediate disk clutch carried by the pivot and engaging the support for frictionally supporting the tape roll thereon, wherein said roll of label-carrying tape is frictionally carried by said holder means between said retainer disks.

12. A machine according to claim 1, further comprising an electrical logic circuit including a pair of electronic cards mounted in the handle and the body and coupled to the photocell, the drive means and the printing means, said circuit controlling the operation of said printing device and driving means, wherein said detection means is coupled to said circuit such that when said emitted infra-red rays are blocked, said circuit is enabled and when said emitted infra-red rays are not blocked, said circuit is disabled.

13. A machine according to claim 1, wherein the photocell detection means is adjustably positioned in the tape path by adjustment means coupled to the detection means for changing the position of said detection means with respect to said body.

14. A machine according to claim 1, further comprising means coupled to the body for binding said machine to a support.

15. A machine according to claim 1, wherein said label is manually removable from said tape and said tape is movable in the tape path when the label is removed to thereby move the gap in the tape between the labels beyond the photocell detection means whereby the printing device and drive means are enabled.

* * * * *